United States Patent [19]

Eigenbrode et al.

[11] 3,963,317

[45] June 15, 1976

[54] ZERO FORCE EDGE CONNECTOR BLOCK

[75] Inventors: George Thomas Eigenbrode, Mechanicsburg; Robert Franklin Evans, New Cumberland, both of Pa.

[73] Assignee: E. I. Du Pont de Nemours and Company, Wilmington, Del.

[22] Filed: Apr. 3, 1975

[21] Appl. No.: 564,795

[52] U.S. Cl. ..... 339/74 R

[51] Int. Cl.[2] ..... H01R 13/62

[58] Field of Search ..... 339/74, 75, 176

[56] References Cited

UNITED STATES PATENTS

| | | | |
|---|---|---|---|
| 3,553,630 | 1/1971 | Scheingold et al. | 339/74 R |
| 3,555,488 | 1/1971 | McIver et al. | 339/75 MP |
| 3,569,904 | 3/1971 | Hill et al. | 339/75 MP |
| 3,611,259 | 10/1971 | Palecek | 339/74 R |
| 3,670,288 | 6/1972 | Evans | 339/74 R |
| 3,848,221 | 11/1974 | Lee, Jr. | 339/74 R |

*Primary Examiner*—Joseph H. McGlynn

[57] ABSTRACT

A zero force edge connector block includes a plurality of terminals for engaging pads on a circuit board, an elongate cam bar extending along the terminals, and a drive for shifting the cam bar along the terminals so that the cam bar engages ramp surfaces in the block and is raised diagonally to engage the terminals and move the terminals to a retracted position. After the board has been positioned in the block, the cam bar is moved back to its initial position, thereby freeing the terminals to engage contact pads on the board.

20 Claims, 10 Drawing Figures

ZERO FORCE EDGE CONNECTOR BLOCK

The invention relates to zero force-type connector blocks where terminals carried in the blocks are withdrawn out of the path of insertion of a circuit board or like member and are subsequently released to engage contact pads on the circuit board. In this way, the circuit board may be freely placed in position for engagement by the terminals without wear on the pads.

Particularly, the invention is directed to a zero force edge-type connector block for forming electrical connections with contact pads on both sides of one edge of a circuit board or like substrate. The connector block includes a specialized cam bar and drive mechanism which simultaneously retract the terminals from the circuit board-receiving slot in the block, thus permitting free or zero force insertion of the circuit board into the slot. The cam bar is positioned between the two rows of terminals in the block and is moved diagonally with respect to the terminals to move the terminals between the retracted and contact positions. When the cam bar is raised, the terminals are retracted from the slot and the circuit board may be freely positioned within the slot. Lowering of the cam bar releases the terminals to engage pads on the board, thereby forming the desired electrical connections between the terminals and the pads. The drive means exerts a longitudinally directed force on the cam bar such that the bar is shifted against rise surfaces or ramps in the block with the result that the bar is moved longitudinally while it is raised or lowered with respect to the terminals. This diagonal motion of the cam bar results in the movement of the terminals toward and away from the slot.

In one embodiment of the invention, the cam bar is shifted by means of a worm gear drive having a thread engagable with a tooth on the cam bar. The drive may be rotated by a screw driver or like tool and usefully multiplies the force supplied by the operator to aid in shifting the cam bar. The cam bar is highly loaded, particularly when it is raised and simultaneously forces all of the terminals in the block away from the circuit board-receiving slot. For instance, some blocks according to the invention may contain 100 or more terminals in each of two rows, with each terminal having a contact force of 100 or more grams depending upon the particular design.

In a second embodiment of the invention, the cam bar is shifted between its two positions by means of a pin vertically mounted in the block and carrying an eccentric cam engagable with a pair of spaced fingers extending to one side of the bar. The cam bar shifts up and down along the eccentric as it moves diagonally between its two positions. This type of drive is particularly adaptable for used in a block where the edge of the circuit board is moved directly downwardly into the circuit board-receiving slot and the drive mechanism must be approached by the operator in the same direction.

In the past, a number of zero force-type connector blocks have been proposed where the edge of the circuit board is inserted freely either directly into the slot or through an open side of the slot. For instance, McIver et al U.S. Pat. No. 3,555,488 discloses a zero force-type connector block in which an actuating member is moved toward the mouth of the slot to force the terminals into engagement with a circuit board previously inserted into the slot. The member is raised by a longitudinal shiftable plate member.

In Konewko et al U.S. Pat. No. 3,697,929 a rotary cam bar raises fingers which engage the free ends of the terminals in the block to force the terminals against a circuit board inserted into the block when the terminals are retracted. The use of rotary cam bars is also taught in Palecek U.S. Pat. No. 3,611,259, Occhipinti et al U.S. Pat. No. 3,638,167 and German Pat. No. 1,073,058.

In Conrad et al U.S. Pat. No. 3,526,869 terminals are held into engagement with circuit board contact pads by spacers which are located to either side of the rows of terminals and are forced against the terminals by longitudinal shifting of a surrounding housing.

Mogle U.S. Pat. No. 3,467,891 and Ecker U.S. Pat. No. 3,596,230 disclose drive means for shifting contacts in zero force connector blocks.

In practice, the prior art zero force-type blocks have proved expensive to manufacture and unreliable in use, frequently because of the high operating force required to shift the cams because of the loading forces exerted upon the cams by terminals in blocks having a large number of terminals. In these blocks the terminal loading forces were reduced in order to bring the cam operating force down to an acceptable level, thus lowering the terminal contact pressure.

In contrast to these prior blocks, the present zero force-type block is relatively inexpensive to make and assemble, and through the use of the specialized cam bar and drive the required operating forces or torque exerted on the worm screw is reduced. This advantage permits increased contact pressures between the terminals and contact pads and permits the use of less expensive contact coatings on the terminals without imparing the quality of the electrical connection. For instance, in some applications, the increased contact pressure permits gold contacts to be replaced by solder contacts.

Other objects and features of the invention will become apparent as the description proceeds, especially when taken in conjunction with the accompanying drawings illustrating the invention, of which there are three sheets.

IN THE DRAWINGS

Figure 9:
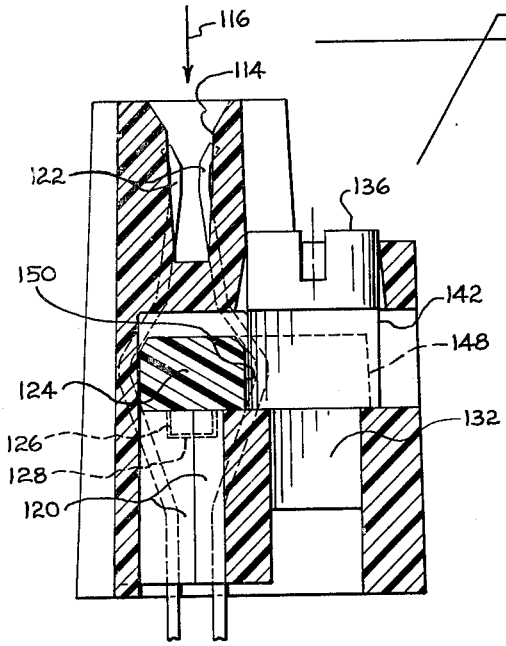
Figure 10:
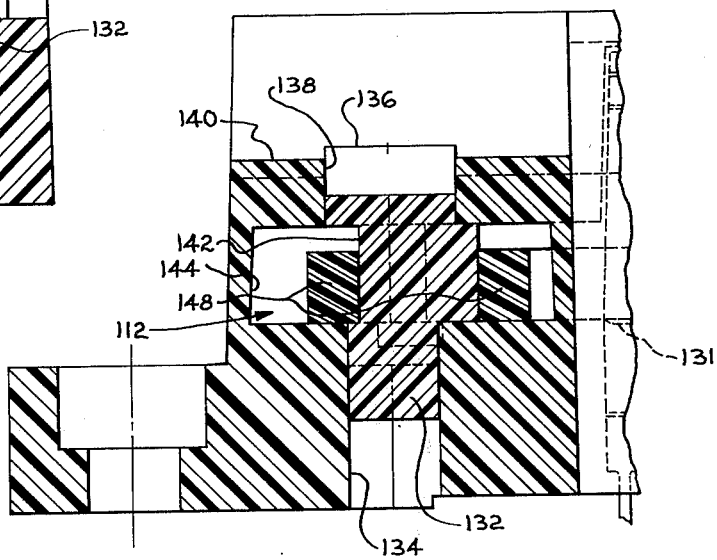
Figure 8:
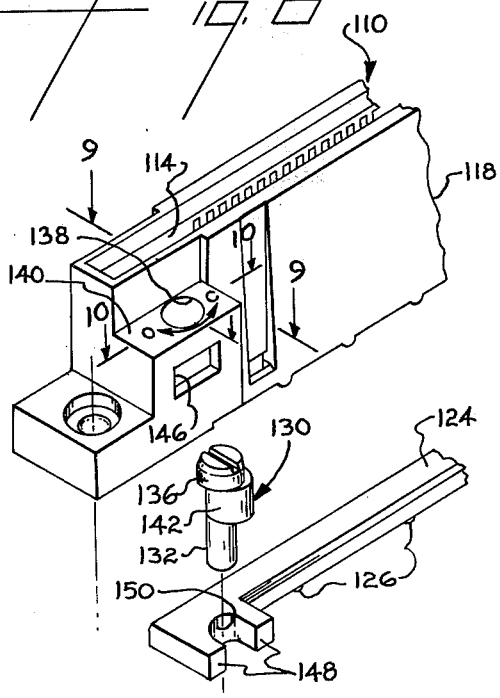

FIG. 8 is an exploded view of a connector block using an alternative cam drive; and FIGS. 9 and 10 are sectional views taken along lines 9—9 and 10—10 respectively of FIG. 8.

Figure 1:
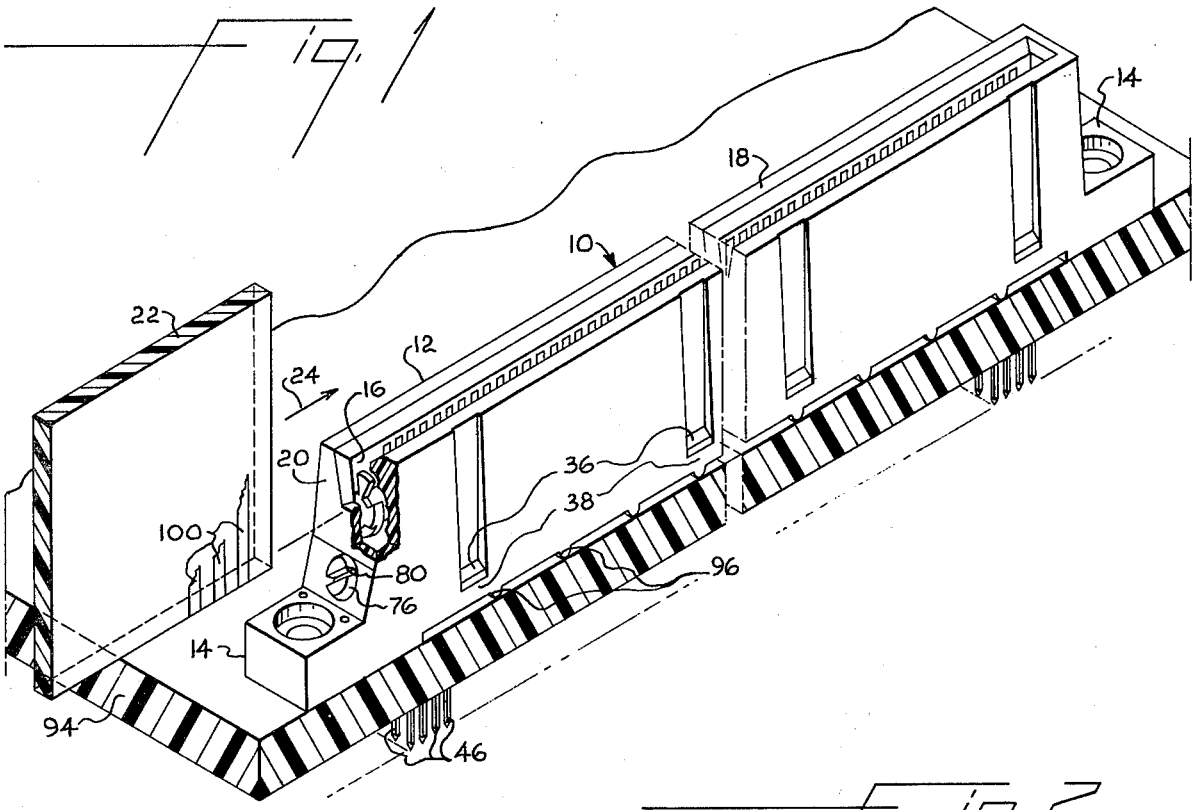
FIG. 1 is a perspective view, partially broken away, of a zero force edge connector block according to the invention mounted on a circuit board.

FIGS. 1 through 7 disclose a zero force edge connector block 10 according to the invention having an elongate body 12 formed of dielectric material with mounting extensions 14 located on either end of the body. A circuit board-receiving slot 16 extends into the body from upper surface 18 thereof and is open at body end 20 to permit loading of a circuit board 22 into the slot by movement in the direction of arrow 24 as shown in FIG. 1 so that the contact edge of the board moves through the slot opening in body end 20.

An elongate terminal assembly 26 is mounted in longitudinally extending recess 28 formed in the bottom surface of body 12 and includes a pair of like elongate plastic insulating bodies 30, each supporting a row of stamp-formed metal contact terminals 32. The plastic members 30 abut against each other at interface 34 and carry latching projections 36 on the outer surfaces thereof such that when the terminal assembly is positioned within the recess 28 in the bottom of the body 12, the projections lock behind body latching shoulders 38 to secure the assembly 26 within the recess 28.

Figure 2:
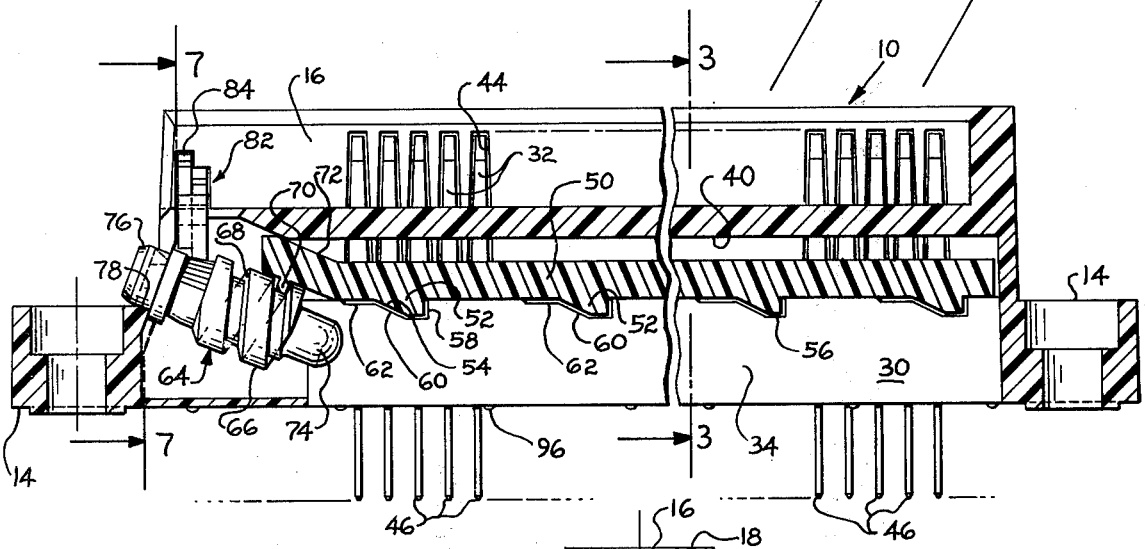
FIG. 2 is a sectional view of the connector block shown in FIG. 1.

As illustrated in FIG. 2, each terminal 32 extends from its member 30 toward slot 16 and includes a portion 38 within the upper end 40 of recess 28 and a portion 42 extending therefrom through a terminal pocket or recess 44 communicating recess portion 40 with circuit board-receiving slot 16. The terminals 32 are free of the side walls of pockets 44 so that they may be moved toward and away from slot 16, as desired hereinafter. Terminal tail portions 46 project below block 10 to facilitate suitable connections with circuit elements. Circuit board contacts 48 are located at the free ends of terminal portions 42 for engagement with contact pads on a circuit board or like member positioned in slot 16. The contacts may be coated with a conductive material to enhance the electrical connection with the circuit board pad.

A terminal cam bar 50 is located in recess portion 40 on top of members 30 and extends longitudinally past the opposed rows of terminals in pockets 44. A number of lift projections 52 are formed on the lower surface of bar 50. The projections are spaced along the length of the bar and each include a rise surface 54 extending from the flat bottom surface of the bar at a shallow angle and facing block end 20. The rise surfaces extend from the bottom surface of the bar to stop surfaces 56 below the bottom of the bar.

When the bar 50 rests flush on the top of members 30, each projection 52 extends freely into a recess 58 formed in the portions 30. Each recess 58 includes a cam surface or ramp 60 facing the adjacent projection rise surface 54 and preferably extending parallel to such surface, and a stop recess 62 adjacent the junction of the cam surface with the top of the members 30. The upper corners 63 of the bar 50 are beveled to facilitate sliding engagement with terminal portions 38 extending into the upper end 4 of recess 28.

A bar shifting drive 64 is mounted in end 20 of block 10 and includes a rotatable worm gear 66 having a thread 68 engagable with tooth 70 carried by end 72 of bar 50. The worm gear 66 includes a rounded thrust end 74 which is seated in a socked formed in the ends of members 30 adjacent body end 20. The work end 76 opposite end 74 extends outwardly of body 12 through a circular opening 78 and includes slot 80 to facilitate rotation of the gear by means of a screw driver or like tool.

The axis of cylindrical worm gear 66 extends generaly along the longitudinal axis of block 10 and is parallel to the planes of the flat cam surfaces 60 and rise surfaces 54. This orientation assures that tooth 70 and thread 68 maintain engagement during rotation of the gear and resultant movement of the cam bar 50. Other types of worm gears could be used, provided that the thread maintains engagement with the tooth on the cam bar while the lift projections are moved across the cam surfaces or ramps 60. A conical worm gear could be used where the thread moves the tooth up and down the surface of the cone. The rotational axis of such a gear could be oriented parallel to the longitudinal axis of the block so that the screw driver or tool used to rotate worm gear would extend longitudinally from the block. Preferably, the connection between the tooth and thread is sufficiently loose to permit the engagement between lift projections and cam surfaces or ramps and stop recesses to locate the cam bar. The bar shifting drive provides the motive force for shifting the cam member but does not locate the cam bar above members 30.

The worm gear drive for the cam bar actuates a gate mechanism 82 which automatically opens and closes the opening at the end of the slot so that circuit boards may be moved into and out of the slot through the end only when the terminals have been withdrawn from the slot. The gate prevents accidental insertion of the board along the gated end of the slot when the cam bar is lowered and the terminals extend into the slot.

Figure 7:
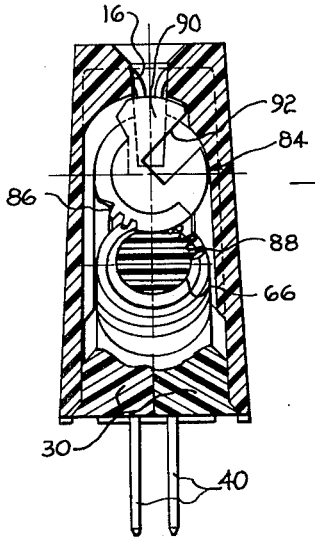
FIG. 7 is a sectional view taken along line 7—7 of FIG. 2.

Mechanism 82 includes a gate member 84 rotatably mounted in a recess at block end 20 and illustrated best in FIG. 7. The gate member includes a number of teeth 86 which, upon rotation of worm gear 66, mesh with teeth 88 carried by the worm gear to rotate the gate in a counter-clockwise direction as shown in FIG. 7 so that gate portion 90 is moved out of slot 16 and recess 92 in the gate is positioned in alignment with the slot 16 thereby opening the slot at block end 20. Teeth 88 extend around only a small circumferential portion of the worm gear so that they engage the teeth 86 on the gate after the worm gear has been rotated nearly 270° in a clockwise direction as shown in FIG. 7. This assures that the terminals are moved out of the slot 16 before the gate is opened, as will be described in further detail in the description of the operation of block 10.

Block 10 is preferably mounted on a support panel 94, which may be a circuit board, by securing means extending through openings in extensions 14. The terminal tail 46 extend through openings in the support 94 and may, if desired, be soldered to printed circuit traces on the lower surface of the support. Standoffs 96 space the terminal-carrying portion of block 10 above the support 94.

Figure 3:
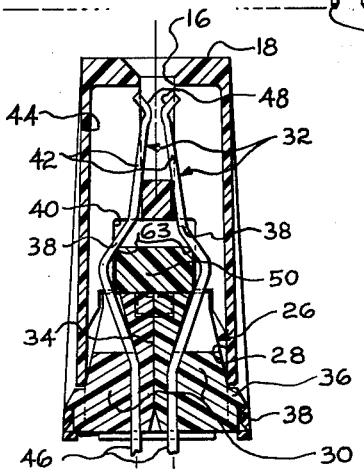
FIG. 3 is a sectional view taken along line 3—3 of FIG. 2.

As illustrated in FIGS. 2, 3, and 7, the cam bar 50 is in the down position relative to the terminals and the terminals extend into the circuit board slot 16. The rotatable gate 84 closes the slot opening at end 20 to prevent insertion of a circuit board into the block. In order to withdraw the terminals 32 from the circuit board slot 16 and open the gate, a tool is inserted in slot 80 to rotate the worm gear in a clockwise direction as illustrated in FIG. 7. Rotation of the gear brings thread 68 into engagement with tooth 70 and draws bar 50 longitudinally to the left, as shown in FIG. 2, such that the rise surfaces 54 of projections 52 slide up the cam surfaces or ramps 60 of the recesses 58. The bar is raised above members 30 and is shifted to the left resulting in a diagonal movement within the block. Lateral movement of the bar is prevented by a sliding fit with the sides of the upper portion 40 of recess 28.

Figure 4:
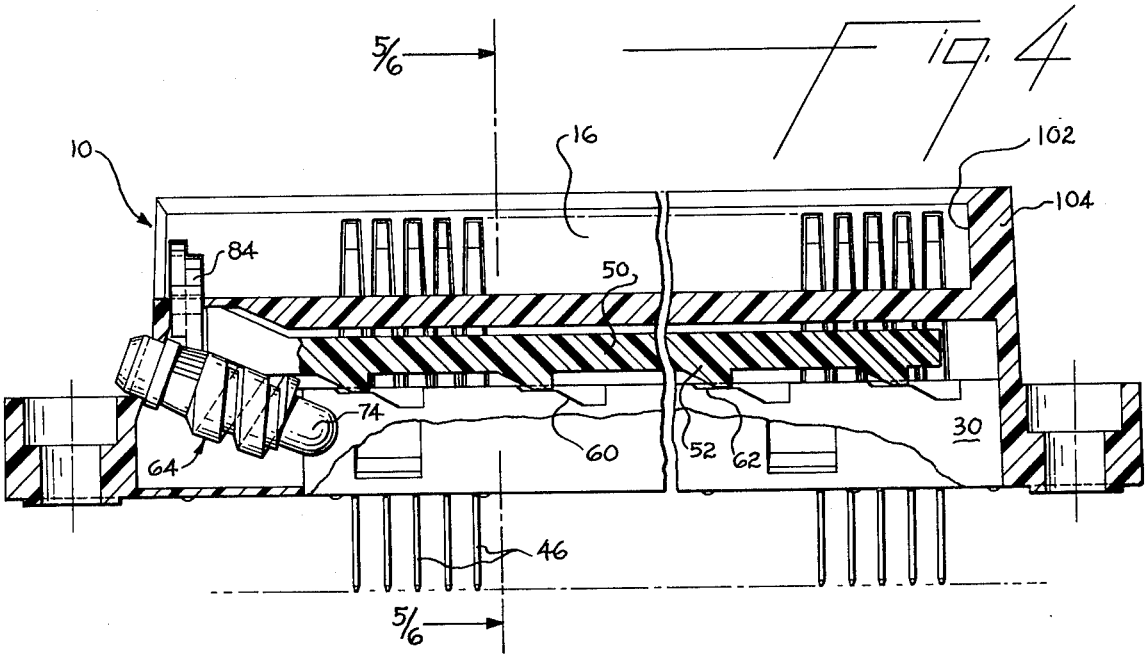
FIG. 4 is a view like that of FIG. 2, but with the cam bar in the block raised to permit insertion of a circuit board.
Figure 5:
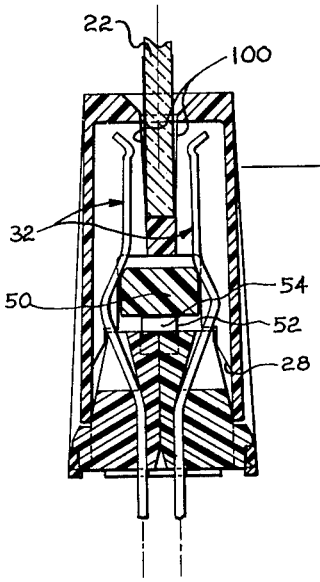
FIG. 5 is a sectional view taken along line 5—5 of FIG. 4 following insertion of a circuit board.
Figure 6:
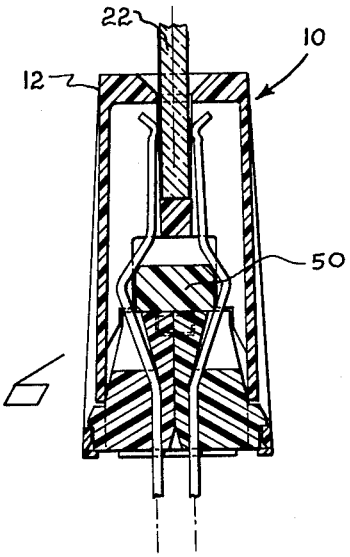
FIG. 6 is a sectional view taken along line 6—6 of FIG. 4 following insertion of the board and release of the terminals to engage pads on the board.

The upward movement of the bar 50 brings the corners 64 of the bar into engagement with terminal portions 38 so that the terminals are bent outwardly of the recess 16. Continued rotation of the worm gear brings the cam bar stop surfaces onto recesses 62 formed in the terminal assembly 26. There is sufficient play between the tooth 70 and thread 68 to permit movement of the bar 50 onto the surfaces 62 despite the fact that during this last movement the bar is not raised above the terminal assembly. When the bar rests on the stop recesses 62, as shown in FIG. 4, the terminals have been forced away from the slot 16 into pockets 44 to facilitate zero force loading. Collapse of the bar is prevented because the projections 52 rest on the flat recesses 62. During spreading of the terminals, the bar 50 is both lifted and shifted longitudinally toward block end 20 so that the bar corners engage and move past the terminals as the cam bar forces the terminals outwardly of slot 16.

The gate mechanism 82 remains closed during raising of the cam bar 50 to spread the terminals. As the cam bar is raised to its uppermost position, teeth 88 on the worm gear are rotated clockwise sufficiently, as illustrated in FIG. 7, to mesh with teeth 86 so that the continued final rotation of the worm rotates the gate 84 in a counter-clockwise direction sufficiently to position the recess 92 in alignment with the slot while the cam bar stop surfaces slide longitudinally on recess surfaces 62. Thus, it is not possible to move a circuit board through the slot at block end 20 until the terminals have been removed from the slot.

With the terminals held away from slot 16 by the cam bar 50 and the gate mechanism is open, a circuit board may be moved through the slot at the end 20 so that it is positioned within the slot with a contact pad 100 thereon on each side of the board located opposite each terminal contact 48. The circuit board 22 is fully inserted when the lead edge thereof bottoms against the slot end 102 at end 104 of the body. When in this position, the trailing edge of the board has been moved past the gate.

The terminals in the block are brought into electrical engagement with contact pads 100 on the inserted board 22 by rotating the worm gear in a counter-clockwise direction as illustrated in FIG. 7. Initial rotation of the worm gear rotates the gate 84 in a clockwise direction to return it to the position of FIG. 7 where it closes the slot 16. Continued rotation of the worm moves the cam bar 50 to the right as illustrated in FIG. 4 along the stop recesses 62 and then to the right and down in a diagonal direction as the projections 52 fall down ramps 60 and the bar returns to the position of FIG. 2 where the terminals are free of corners 63, move towards slot 16 and establish electrical contact with the aligned contact pads 100 on board 22.

FIGS. 8, 9, and 10 illustrate a second embodiment of the invention. Zero force edge connector block 110 is similar to block 10 illustrated in the previous figures with the exception that an alternative bar shift drive 112 is used in place of the worm gear bar shifting drive 64. The block 110 includes a body 118 having a circuit board-receiving slot 114 closed at both ends to receive circuit boards with contacts on both sides where the edge of the board is moved into the slot in the direction of arrow 116 as illustrated in FIG. 9. A pair of plastic members 120 each carrying a row of terminals 122 extending along one side of the slot 114, are mounted in body 118 as described in connection with block 10 and a cam bar 124 rests on the upper surfaces of the members 120. The cam bar carries lift projections 126 which cooperate with cam surfaces or ramps 128 and stop recesses 130 to raise the cam bar diagonally as it is shifted longitudinally along the block and raised above the members 120 by the bar shifting drive 112. This drive includes a cam pin 130 mounted in body 118 with end 132 fitted in bore 134 and slotted pin head 136 located in an opening 138 in a stepped surface 140. The cam pin includes a cylindrical eccentric 142 which rotates with a cavity 144 in the body 118. Cavity 144 communicates with the outside of the body through window 146.

A pair of fingers 148 extend to one side of the cam bar 124 at the end adjacent the pin 130. The eccentric 142 is fitted between the fingers 148 which are spaced apart to make a close fit with the cylindrical eccentric. Semi-cylindrical recess 150 at the bottom of the space between the fingers 148 conforms to the shape of the eccentric. As illustrated in FIGS. 9 and 10, the eccentric has a height greater than the height of the fingers to permit up and down movement of the cam bar with respect to the cam pin.

FIG. 10 illustrates the cam bar 124 in the down position with the eccentric facing to the right fitted in the bottom of recess 150. The cam bar is moved from the lower to the upper position to spread the terminals outwardly of slot 114 by inserting a tool into the slot in cam pin head 136 and rotating the pin in a clockwise direction so that the lobe of the eccentric rotates past window 146, 180° from the position of FIG. 10. This motion moves the cam bar to the left so that the lift projections 126 ride up the cam surfaces or ramps 128 and rest upon the stop surfaces 131. When the cam bar is fully raised, the bar has been shifted to the left as illustrated in FIG. 10, twice the throw of the eccentric and the eccentric is again seated against the bottom of recess 150. As the cam bar is constrained against lateral movement, seating of the eccentric against the bottom of recess 150, whether the cam bar is in the lower or raised positions, limits rotation of the cam pin.

With the cam bar in the raised position, the terminals 122 are moved outwardly of the slot 114 into their respective pockets in body 118 and a circuit board may be positioned within slot 114 free of the terminals. When the board is moved into the slot, the cam pin 130 may be rotated in the counter-clockwise direction to lower the cam bar and permit terminals 122 to move toward the slot for engagement with contact pads on both sides of the circuit board seated in the slot. As illustrated in FIG. 8, suitable indicia may be provided on surface 140 to indicate the direction of rotation of the cam pin for moving the cam bar between the open and closed positions.

While we have illustrated and described preferred embodiments of our invention, it is understood that these are capable of modification, and we therefore do not wish to be limited to the precise details set forth, but desire to avail ourselves of such changes and alterations as fall within the purview of the following claims.

What we claim as our invention is:

1. A zero force connector block including a support, a row of terminals extending from said support and including contacts, an elongate cam bar extending along said row of terminals, said bar including surface means engageable with said terminals upon diagonal movement of the bar along its length and away from the support to flex the terminals and move the contacts between contact positions where the contacts engage pads on a circuit board or like member located adjacent the block and retracted positions away from the contact positions, a drive mechanism for longitudinally shifting said cam bar, and connection means between said cam bar and support for moving the cam bar away from the support in response to longitudinal movement of the cam bar by the drive mechanism.

2. A zero force connector block as in claim 1, including a shiftable gate for closing the path of movement of a circuit board toward the connector block, lost motion drive means connecting said gate and said drive whereby the gate is opened and closed only during movement of the drive when the terminals approach and move away from the retracted positions, said gate being closed as the terminals move toward and away from the contact positions.

3. A zero force connector block as in claim 1 wherein said drive mechanism includes a worm gear rotatably mounted on said support and having a thread with a work surface movable upon rotation of the gear in a direction parallel to the direction of diagonal movement of the cam bar, and the cam bar includes a tooth engagable with the work surface on the thread.

4. A zero force connector block as in claim 3 wherein said connection means comprises shallow ramps on one of said support or cam bar and projections engagable with said ramps on the other of said support or cam bar whereby longitudinal movement of the cam bar moves the projections along the ramps, said one of said support or cam bar including stop surfaces at the end of said ramps engagable by said projections when the support and cam bar are fully separated.

5. A zero force connector block as in claim 3 wherein said worm gear is cylindrical.

6. A zero force connector block as in claim 3, including a shiftable gate located in the path of movement of a circuit board toward the block, and a lost motion connection between said gate and said drive mechanism means whereby the gate is opened and closed only during movement of the drive when the terminals approach and move away from the retracted positions, said gate being closed as the terminals move toward and away from the contact positions.

7. A zero force connector block as in claim 6, wherein said gate includes a member rotatably mounted in said support, teeth on said member engagable with teeth on said worm gear during a portion of the rotation of the worm gear only, said member including a portion movable into and out of the path of movement of the circuit board.

8. A zero force edge connector block including a body having a circuit board edge-receiving slot, two rows of terminals extending along the body to either side of the slot, an elongate cam bar positioned below the slot and extending along the length of the block between the rows of terminals, said cam bar including surfaces engagable with the terminals upon movement of the cam bar toward the slot to flex the terminals away from the slot, a drive mechanism engaging the cam bar for applying a longitudinal force to the cam bar for longitudinally shifting the cam bar, connection means between the cam bar and the body for moving the cam bar toward the slot in response to longitudinal shifting of the cam bar by the drive mechanism, whereby actuation of the drive mechanism results in movement of the cam bar in a diagonal direction with respect to the body and brings the surfaces into engagement with the terminals and moves the terminals away from the slot.

9. A zero force edge connector block as in claim 8 wherein the drive mechanism includes a rotatable cam pin mounted in the body, the pin including a eccentric, the cam bar includes a pair of fingers positioned to either side of the eccentric, the height of the eccentric being greater than the height of the fingers to permit movement of the cam bar along the axis of the cam pin.

10. A zero force edge connector block as in claim 8 wherein the drive mechanism includes a worm gear having a spiral thread and the cam bar includes a tooth engagable with the thread such that rotation of the gear brings the thread into engagement with the tooth and shifts the cam bar longitudinally.

11. A zero force edge connector block as in claim 10, wherein the connection means comprises shallow ramps and followers movable along the ramps.

12. A zero force edge connector block as in claim 11, wherein the connection means includes stop surfaces at the ends of the ramps engagable by the followers when the cam bar is adjacent the slot.

13. A zero force edge connector block as in claim 12, including an opening at one end of the slot, a gate movable into and out of the opening, and a lost motion drive connection between the worm gear and gate operable to move the gate into and out of the opening as the followers move off of and onto the stop surfaces.

14. A zero force edge connector block as in claim 13, wherein the gate comprises a rotary member confined in the body, and the drive connection includes one or more teeth extending around only a portion of the circumference of either the gate or the worm gear and one or more teeth on the other of the gate or the worm gear engagable with the first mentioned one or more teeth.

15. A zero force connector block including a body, a row of terminals carried by the body, a cam bar movable to shift the position of the terminals between a contact position where the terminals engage pads on a circuit board or like memer and a retracted position, a drive for shifting the cam bar, a gate carried by the body and including a member movable between a circuit board blocking position and a retracted position free of a circuit board as the circuit board is moved toward the block, and lost motion drive means between the drive and the gate for shifting the gate between the two positions only when the terminals are retracted.

16. A zero force edge connector block including a body having an elongate circuit board-receiving slot in one side thereof and a recess extending along an opposite side thereof parallel to the slot, two rows of terminal-receiving pockets extending along the body, the pockets communicating said slot and recess; a terminal assembly including an elongate insulating member and two rows of terminals projecting from said member, said assembly being positioned within said recess with each row of terinals extending through the pockets in one row of pockets with terminal portions normally positioned within the slot; a cam bar in the recess between the member and the slot, parts of said terminals normally extending into the recess for engagement with surfaces on the cam bar upon movement of the cam bar toward the slot; a drive mechanism engagable with the cam bar to shift the cam bar longitudinally aong the recess; and connection means between the cam bar and the member for moving the cam bar toward the slot in response to longitudinal movement of the cam bar by the drive mechanism whereby actuation of the drive results in movement of the cam bar in a diagonal direction with respect to the body and brings the surfaces on the cam bar into engagement with the terminal parts to retract the terminals away from the slot and into the pockets.

17. A zero force edge connector block as in claim 16, wherein said member includes a pair of like insulating elements, a row of terminals projecting from each element, said connection means comprises a shallow ramp and follower connection between the cam bar and both elements, and a latch connection between the body and each element for confining the elements within the recess.

18. A zero force edge connector block as in claim 16, wherein said drive mechanism comprises a worm gear, the cam bar includes a tooth engagable with a thread on the gear, and including a thrust bearing between an end of the worm gear and the member.

19. A zero force edge connector block as in claim 16, including an opening at one end of the slot, a gate movable into and out of the opening, and a lost motion drive connection between the drive mechanism and the gate for moving the gate into and out of the opening only when the terminals are retracted in the pockets.

20. A zero force connector block including a body, a row of terminals carried by the body, a cam bar moveable to shift the position of the terminals between a contact position where the terminals engage pads of a circuit board or like member and a retracted position, a drive for shifting the cam bar, a gate carried by the body and including a member moveable between a circuit board blocking position and a retracted position free of the circuit board as the circuit board is moved toward the block, and lost motion drive means operable in response to actuation of the drive for shifting the gate between the two positions only when the terminals are retracted.

* * * * *